US007036961B2

(12) United States Patent
Defouw et al.

(10) Patent No.: US 7,036,961 B2
(45) Date of Patent: May 2, 2006

(54) RECESSED LIGHTING FIXTURE WITH BATTERY BACKUP

(75) Inventors: Douglas J. Defouw, Moore, SC (US); Rich D'Andrea, Greenville, SC (US)

(73) Assignee: Hubbell Incorporated, Orange, CT (US)

( * ) Notice: Subject to any disclaimer, the term of this patent is extended or adjusted under 35 U.S.C. 154(b) by 178 days.

(21) Appl. No.: 10/187,387

(22) Filed: Jul. 1, 2002

(65) Prior Publication Data

US 2004/0001337 A1 Jan. 1, 2004

(51) Int. Cl.
*F21V 17/08* (2006.01)

(52) U.S. Cl. ..... 362/364; 362/183; 362/20; 307/66

(58) Field of Classification Search ..... 362/157, 362/20, 147, 364, 365, 359, 812, 555, 183; 307/66

See application file for complete search history.

(56) References Cited

U.S. PATENT DOCUMENTS 3,860,829 A * 1/1975 Fabbri ..... 307/66
5,303,124 A * 4/1994 Wrobel ..... 362/20
5,379,199 A * 1/1995 Hirshenhorn et al. ..... 362/147
5,473,517 A * 12/1995 Blackman ..... 362/95
D380,853 S 7/1997 Johnson
5,676,455 A 10/1997 Johnson et al.
5,851,061 A 12/1998 Hegarty
5,988,829 A * 11/1999 Holder ..... 362/217
6,648,496 B1 * 11/2003 Elghoroury et al. ..... 362/555

OTHER PUBLICATIONS

Progress Lighting catalog (3 pages).
Advent Lighting Product Information © 2002 (4 pages).
I/R, F/R, and F/ER Information (2 pages).

* cited by examiner

*Primary Examiner*—Sandra O'Shea
*Assistant Examiner*—Ismael Negron
(74) *Attorney, Agent, or Firm*—Alfred N. Goodman; Mark S. Bicks; Marcus R. Mickney

(57) ABSTRACT

A recessed lighting fixture that includes a battery assembly integrally connected to a recessed enclosure, such battery assembly including a battery that can supply the lighting fixture with power in the event of a power outage. In one embodiment, the battery assembly includes a ballast plate to which the light source (e.g., incandescent or fluorescent lamps) and the battery are connected. The ballast plate can be connected to the recessed enclosure so that the battery is disposed within an open face defined by the recessed wall enclosure.

29 Claims, 7 Drawing Sheets

RECESSED LIGHTING FIXTURE WITH BATTERY BACKUP

BACKGROUND OF THE INVENTION

Recessed lighting fixtures are commonly used in commercial, residential, and public access buildings. For example, wall lighting fixtures, commonly referred to as "sconces", are typically mounted flush onto a wall and contain a light source such as an incandescent or fluorescent lamp. One problem with many conventional recessed lighting fixtures is that, during a power outage, the fixtures cease to illuminate. As a result, it is often difficult for a person to move throughout a building containing such lighting fixtures, particularly when the fixtures are used as wall sconces to illuminate hallways and other pathways of egress.

In response to these difficulties, recessed lighting fixtures have been developed that include a battery to supply the lighting fixture with temporary power in an emergency. However, batteries that are capable of providing a sufficient amount of power for a sufficient period of time are often relatively large and bulky. Thus, the lighting fixtures containing such batteries tend to be bulky and require a relatively large amount of wall or ceiling space. These bulky fixtures may also reduce the ease in which the fixtures can be installed and accessed.

As such, a need currently exists for an improved recessed lighting fixture that can provide back-up power in an emergency and yet still take up a relatively small amount of space.

SUMMARY OF THE INVENTION

In accordance with one embodiment of the present invention, a recessed lighting fixture is provided that includes a recessed enclosure having a back wall and an open face defined by at least two side walls. For example, in some embodiments, the recessed enclosure is formed from four side walls and has a length dimension of between about 7.5 inches to about 8 inches, a width dimension of between about 4.75 inches to about 5 inches, and a depth dimension of between about 3.25 inches to about 3.5 inches.

The recessed lighting fixture also includes a light source (e.g., incandescent or fluorescent lamp) that is in operable communication with the recessed enclosure. During normal operation, the light source receives power from a power supply.

Furthermore, the recessed lighting fixture includes a battery assembly that is capable of temporarily providing back-up power during a power outage. In particular, the battery assembly includes a battery that, in some embodiments, can provide power for a minimum of about 90 minutes. Besides being capable of providing back-up power, the battery assembly is also integrally connected to the recessed enclosure so that the resulting lighting fixture can be easily installed and accessed by a user. For example, in one embodiment, the battery assembly includes a ballast plate having a first surface and a second surface facing away from the first surface. The battery can be connected to the first surface, while the light source can be connected to the second surface. In some embodiments, for example, the ballast plate can be connected to a tab portion, which is connected to one or more of the walls of the recessed enclosure so that the battery, which may be relatively large in size, is disposed within the open face defined by the walls of the recessed enclosure.

In some embodiments, the recessed lighting fixture can also include a lighting circuit unit that is in electrical communication with the light source and battery. To form a more integral structure, the lighting circuit unit can also, in some embodiments, be disposed within the open face of the recessed enclosure between the battery and the back wall of the recessed enclosure.

Optionally, the recessed lighting fixture also includes a light diffuser that is in communication with the light source to distribute in a pattern light rays produced by the light source. If desired, a tray assembly can be connected to the recessed enclosure in order to support such light diffuser. When utilized, the tray assembly may allow a user to readily access the light diffuser and to easily interchange it with other light diffusers.

Other features and aspects of the present invention are discussed in more detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Repeat use of references characters in the present specification and drawings is intended to represent same or analogous features or elements of the invention.

DETAILED DESCRIPTION OF REPRESENTATIVE EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a recessed lighting fixture that contains a backup system in the event of power failure. In particular, the lighting fixture of the present invention contains a battery assembly that can be connected to a recessed enclosure, such as a wall enclosure. It has been discovered that the recessed lighting fixture of the present invention can provide emergency lighting for an extended period of time during a power outage. In addition, it has also been discovered that the particular configuration of the lighting fixture allows it to be incorporated with a battery without destroying the ability of the lighting fixture to be easily installed and accessed.

Figure 1:
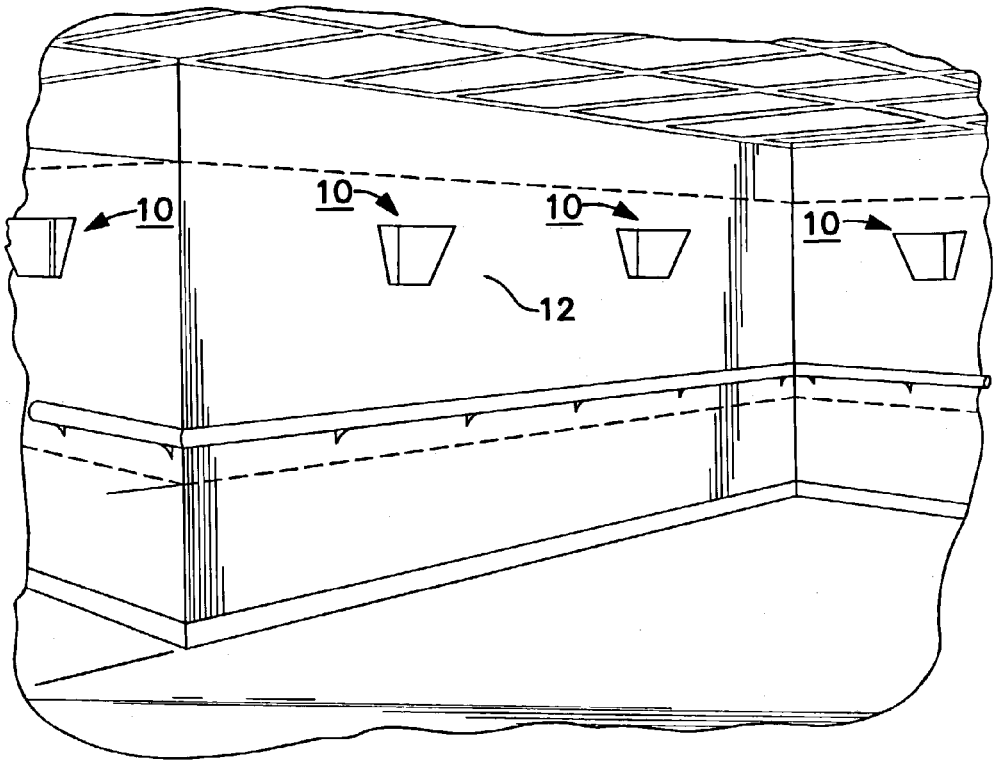
FIG. 1 illustrates one embodiment of a lighting fixture of the present invention mounted within the walls of a building.

Referring to FIG. 1, for example, one embodiment of a lighting fixture that can be utilized in the present invention is illustrated. As shown, a lighting fixture 10, also commonly referred to as a "wall sconce", is positioned within a wall 12. In the illustrated embodiment, the lighting fixture 10 is recessed within the wall 12. However, it should be understood that the lighting fixture 10 can also be positioned in other locations of a building, such as in the ceiling.

Figure 2:
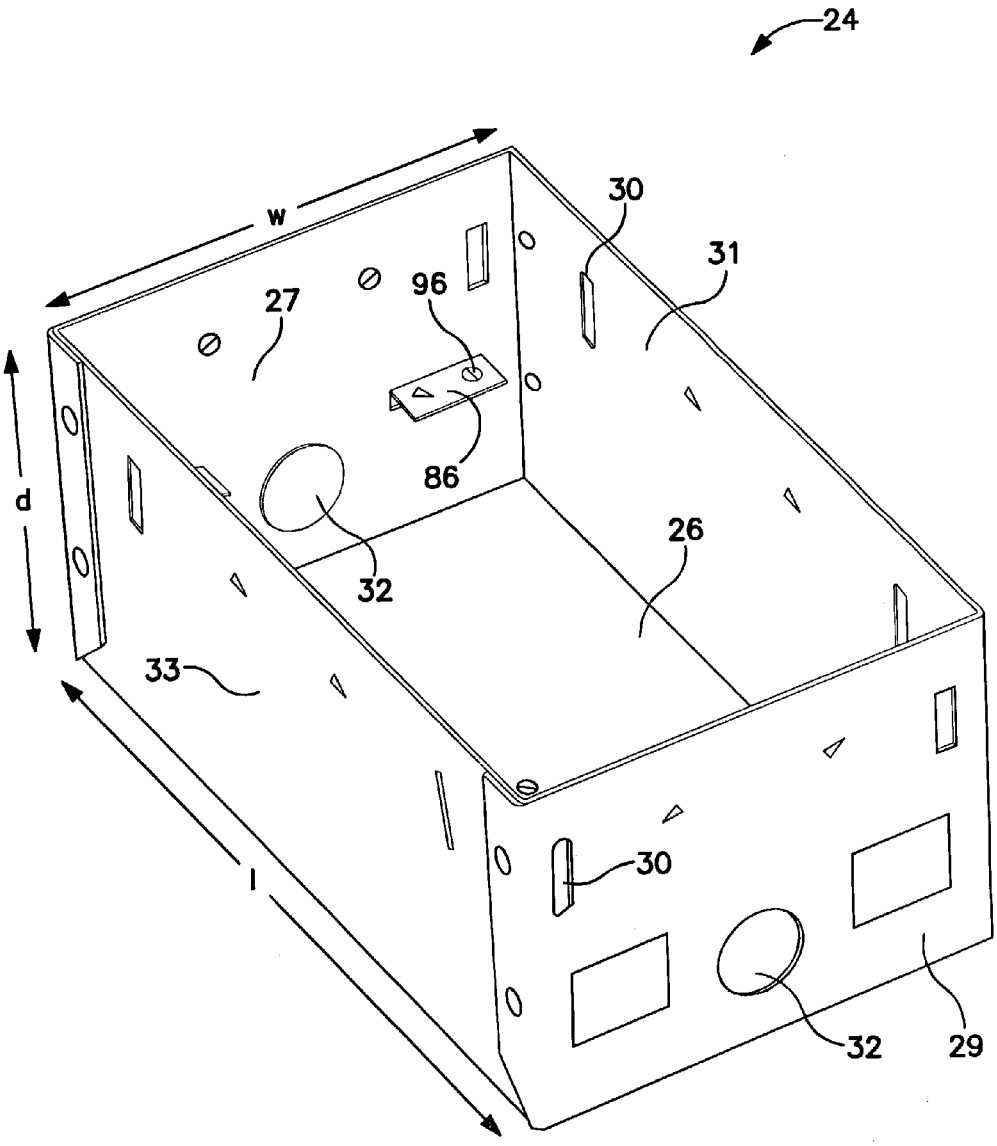
FIG. 2 is a perspective view of one embodiment of a recessed enclosure that can be used in the present invention.
Figure 3:
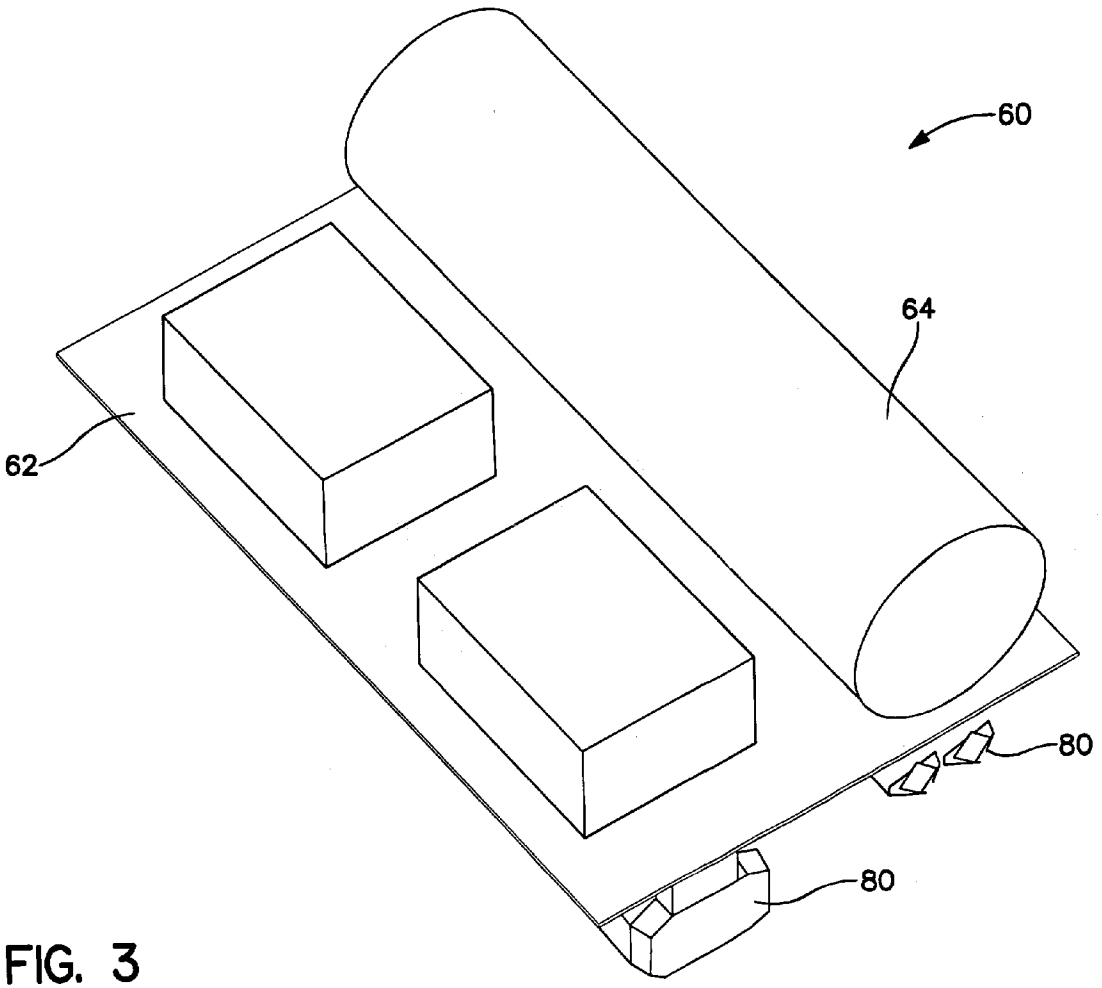
FIG. 3 is a perspective view of one embodiment of a battery assembly that can be used in the present invention.

The lighting fixture 10 can generally have a variety of different configurations. For instance, as shown in FIG. 2, one embodiment of the lighting fixture 10 includes a recessed enclosure 24 having side walls 27 and 29 positioned adjacent to side walls 31 and 33. In general, the side walls of the recessed enclosure 24 can have a variety of different shapes and/or sizes. For instance, in some embodiments, the recessed enclosure 24 can have a length dimension "l" of between about 5 inches to about 10 inches, and in some embodiments, between about 7.5 inches to about 8 inches. Moreover, in some embodiments, the recessed enclosure 24 can also have a width dimension "w" of between about 2 inches to about 7 inches, and in some embodiments, between about 4.75 inches to about 5 inches. Further, the recessed enclosure 24 can also have a depth dimension "d" of between about 1 inch to about 5 inches, and in some embodiments, between about 3.25 inches to about 3.5 inches.

The recessed enclosure 24 also includes a back wall 26 that may be applied with a coating. For instance, when utilized, the coating can contain a reflective substance, such as a white paint, so as to reflect the light rays generated by the light sources 80 (shown in FIGS. 3–6). The coating may also be placed on other surfaces of the enclosure 24, such as the interior surfaces of the walls 27, 29, 31, and 33.

As shown, the recessed enclosure 24 also contains a plurality of removable apertures 32, sometimes referred to as "knockouts", which are selectively located in one or more walls of the enclosure 24 to allow for the insertion of an electric cable (not shown) that receives power from any power source. This cable can thereby provide power to the light sources 80 (shown in FIGS. 3–6) during normal operation.

Additionally, the recessed enclosure 24 may be incorporated with a variety of other features depending on whether it is to be mounted within a building that is being constructed or a building that is finished. For instance, referring to FIG. 2, one embodiment of a recessed enclosure 24 that can be easily mounted within a building that is finished or under construction, in either a horizontal or vertical orientation is shown. Specifically, the recessed enclosure 24 includes at least one aperture 30 for mounting the enclosure 24 in a horizontal or vertical configuration. The apertures 30 are located so as to accommodate the connection of various stabilizing brackets and/or retaining clips that can be used to attach the lighting fixture 10 to a wall or ceiling joist. Various techniques for mounting the lighting fixture of the present invention within a building are also described in U.S. Pat. No. 5,379,199 to Hirshenhorn, et al., which is incorporated herein in its entirety by reference thereto for all purposes.

In accordance with one embodiment of the present invention, the lighting fixture may also contain a light diffuser that can direct light in a certain pattern. In particular, the light diffuser may be selected to have any particular shape and can be made from any material, such as acrylics, metal or glass, etc., so that a multiplicity of direct (down-lighting), indirect (up-lighting) or outward lighting patterns may be produced. For example, referring to FIG. 7, one embodiment of a light diffuser that can be used in the present invention is illustrated. As shown, the light diffuser 150 cooperates with a horizontally mounted recessed enclosure to produce an upwardly directed light pattern 152 having a plurality of light rays 154 and an outwardly directed light pattern 156 having a plurality of light rays 158. In this embodiment, for such light patterns 152 and 156, respectively, the light diffuser 150 has a circular shape. Moreover, referring to FIG. 8, another embodiment of a light diffuser that can be used in the present invention is shown. As depicted, the light diffuser 160 cooperates with a vertically oriented recessed enclosure so as to produce upward lighting 162, outward lighting 164, and downward lighting 166 that respectively contain a plurality of light rays 168, 170 and 172.

Figure 4:
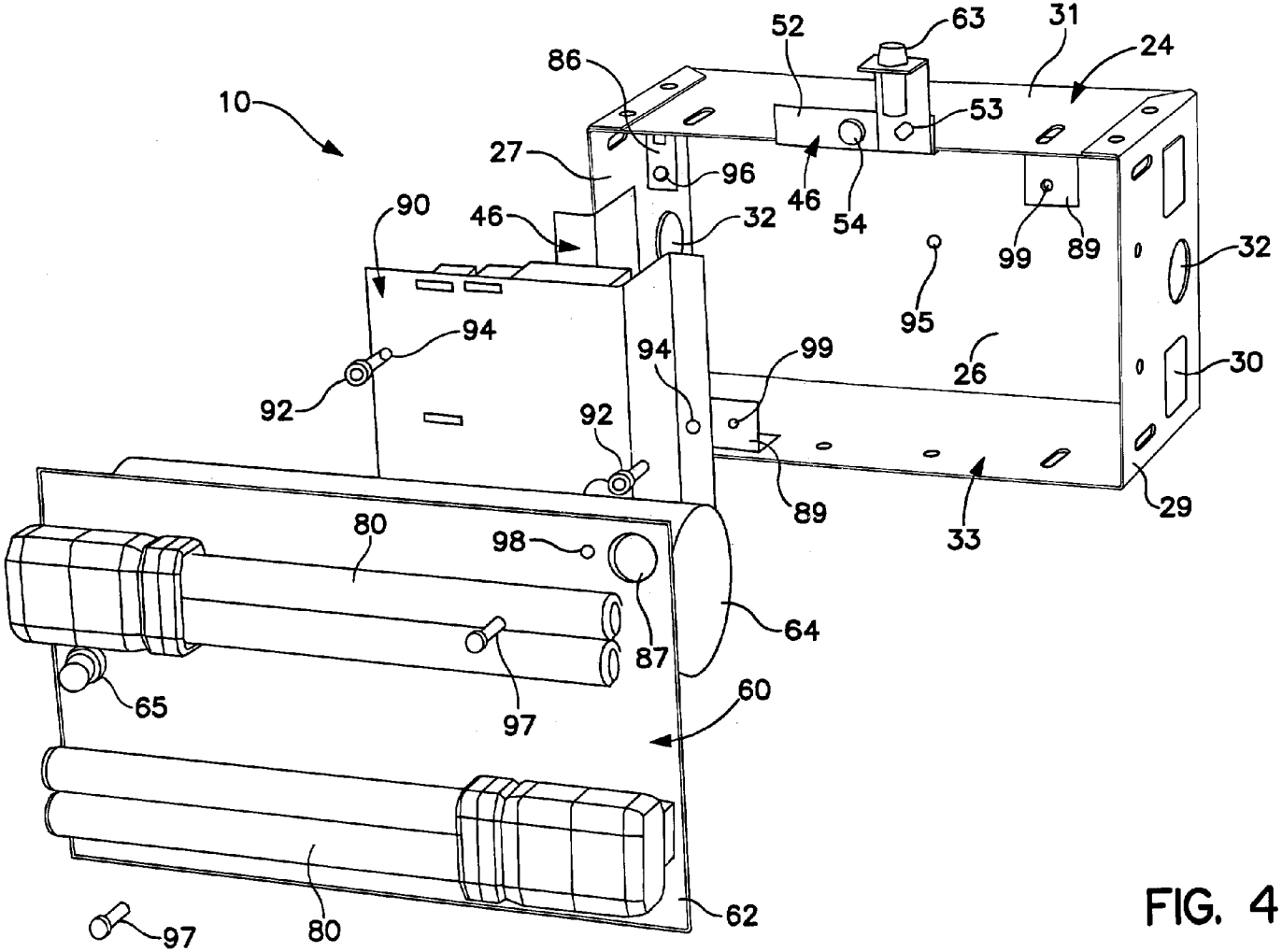
FIG. 4 illustrates one embodiment for assembling a lighting fixture of the present invention.

In order to connect a light diffuser to the recessed enclosure 24, a variety of techniques may be utilized. For example, in one embodiment, such as shown in FIG. 4, the recessed enclosure 24 is equipped with one or more tray assemblies 46. In this embodiment, one tray assembly 46 is mounted to the interior surface of the wall 31, and another tray assembly 46 is mounted to the interior surface of the wall 27. The tray assemblies 46 each have a partition 52 and a connecting member, such as a thumbscrew 54, and are mounted by inserting one or more fastening devices (e.g., screws) through openings of the tray assembly 46 and the recessed enclosure 24.

Figure 7:
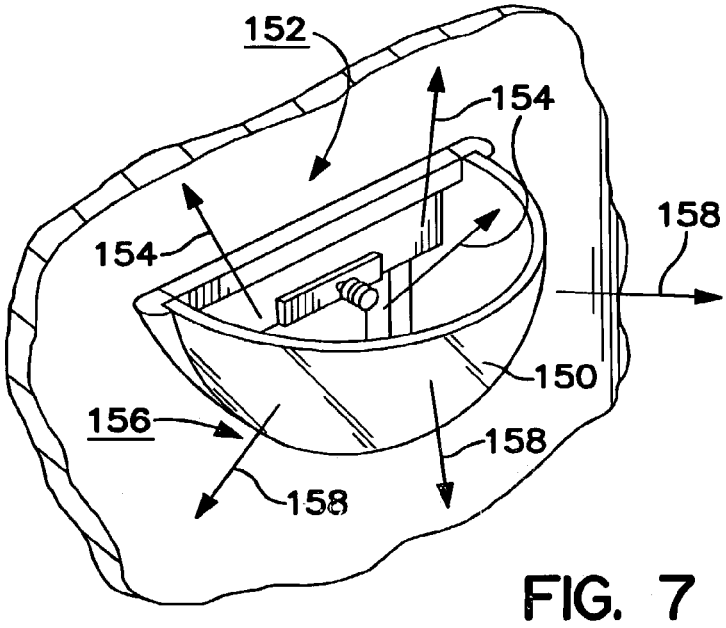
FIG. 7 is a perspective view of one embodiment of a light diffuser that can be used in the present invention.
Figure 8:
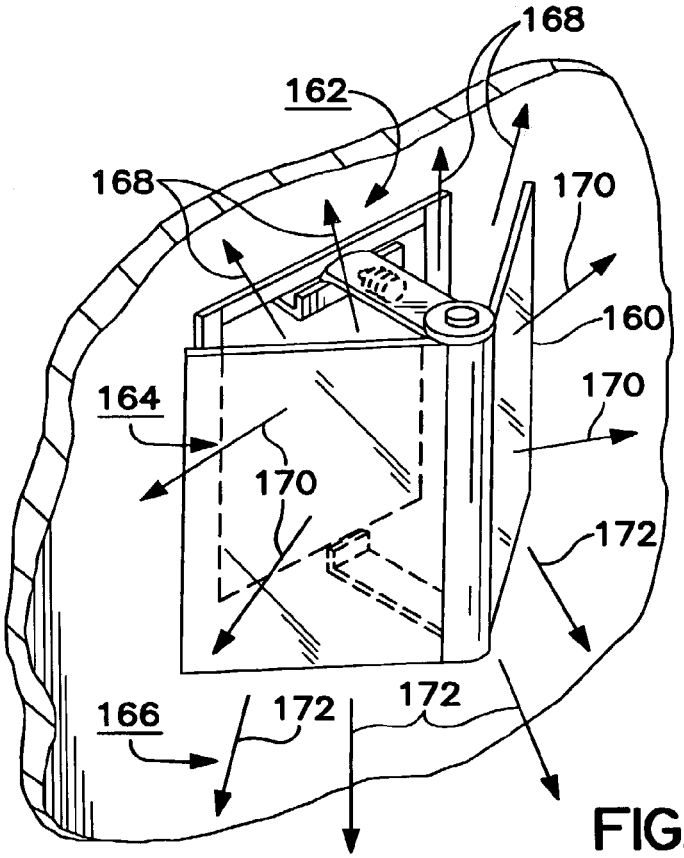
FIG. 8 is a perspective view of another embodiment of a light diffuser that can be used in the present invention.

In one embodiment, to attach a light diffuser to one of the tray assemblies 46, the thumbscrew 54 is first removed. Thereafter, the aperture through which the thumbscrew 54 was inserted is aligned with an aperture of a light diffuser (such as shown in FIGS. 7–8). Once aligned, the thumbscrew 54 can then be inserted through the apertures of the light diffuser and the tray assembly 46 to mount the light diffuser thereto. Alternatively, the light diffuser may also be mounted to other positions of the tray assembly 46, such as to the aperture 53 shown in FIG. 4.

By using the tray assembly in a manner such as described above, light diffusers can be rapidly installed and/or interchanged to easily achieve various light patterns, improve general maintenance thereof, and provide various aesthetic styles that are particularly suited for different lighting applications. Further, such benefits can be provided without disturbing the electrical connections and components of the recessed wall lighting fixture 10.

In accordance with the present invention, the lighting fixture also includes a battery assembly that can temporarily provide the lighting fixture with power in the event of power failure. In general, any of a variety of battery assemblies can be used in the present invention. One commercially available example of a battery assembly that can be used in the present invention is a battery kit sold as model number I-13-L by Iota Engineering Co. of Tucson, Ariz.

Referring to FIGS. 3–6, for example, one embodiment of a battery assembly that can be used in the present invention is illustrated. As shown, the battery assembly includes at least one battery 64 that is connected to a surface of the ballast plate 62. The ballast plate 62 includes a reset switch 65 and defines an opening 87 through which cables 88 can be provided to connect the battery 64 to an indicator light 63 (e.g., LED) that can illuminate when the battery power is being utilized and/or charged.

The battery 64 can generally have any desired shape or size, and also have any desired power. In some embodiments, for example, the battery 64 can have a cylindrical shape with a diameter of between about 0.5 inches to about 5.0 inches. Moreover, in some embodiments, the battery 64 can have a length of between about 1.0 inch to about 15.0 inches. In one embodiment, for example, the battery 64 has a cylindrical shape with a diameter of 1.375 inches and a length of 7.375 inches.

In addition to having various shapes and/or sizes, the battery 64 can also have any current and/or power capacity desired. For instance, in one embodiment, the battery 64 has an input voltage of 120/277 volts at 60 Hertz and an input wattage of 3.5 watts. Thus, in this embodiment, the battery 64 can provide an initial output of about 600 lumens for a single lamp, which can result in an illumination of the lamp for a minimum of about 90 minutes after power failure.

As shown in FIGS. 3–6, the battery assembly 60 also communicates with one or more light sources 80. For instance, the illustrated light sources 80 are fluorescent lamps. However, it should be understood that any other light source may be used in the present invention, such as, for example, an incandescent lamp. Moreover, it should also be understood that other battery assembly configurations may be used in the present invention.

Besides the components described above, the lighting fixture of the present invention also typically includes a circuit unit that is in electrical communication with the battery assembly and light sources. For instance, referring to FIG. 4, one embodiment of a lighting fixture 10 is shown that includes a lighting circuit unit 90. The circuit unit 90 can have a variety of different shapes and/or sizes. For example, in one embodiment, the circuit unit 90 is an open circuit board assembly having a length of 4.0 inches, a width of 2.75 inches, and a height of 1.0 inch. The circuit unit 90 is typically connected to the battery assembly 90 via one or more electrical connections (not shown) so that, in the event of a power outage, it can allow the light sources 80 to receive power from the battery 64 instead of, for example, a standard power outlet.

The components of the lighting fixture 10 described above can generally be assembled in any manner desired. For instance, one method for assembling the lighting fixture 10 will now be described in more detail. In particular, referring to FIG. 4, the lighting circuit unit 90 is first connected to the recessed enclosure 24. The circuit unit 90 can be connected to the enclosure 24 using fastener(s), adhesive(s), magnetic device(s), etc. For instance, in the embodiment illustrated in FIG. 4, two plastic offset fasteners 92 are used to connect the circuit unit 90 to the enclosure 24. Specifically, the fasteners 92 are first inserted through two apertures 94 of the circuit unit 90. Thereafter, one of the fasteners 92 is then inserted through a first aperture 95 defined by the back wall 26 of the recessed enclosure 24, while the other fastener 92 is inserted through a second aperture 96 defined by a tab 86, thereby connecting the circuit unit 90 to the recessed enclosure 24.

Once the circuit unit 90 is connected to the enclosure 24, the battery assembly 60 may then be connected to the enclosure 24. Various connection techniques may be utilized to connect the battery assembly 60 to the enclosure 24, such as using fastener(s), adhesive(s), magnetic device(s), etc. For instance, in the embodiment illustrated in FIG. 4, two screws 97 are first inserted through two apertures 98 (one of which is shown in FIG. 4) of the ballast plate 62. Thereafter, the screws 97 are then inserted through two additional apertures 99 defined by two tabs 89, thereby connecting the battery assembly 60 to the recessed enclosure 24.

Figure 5:
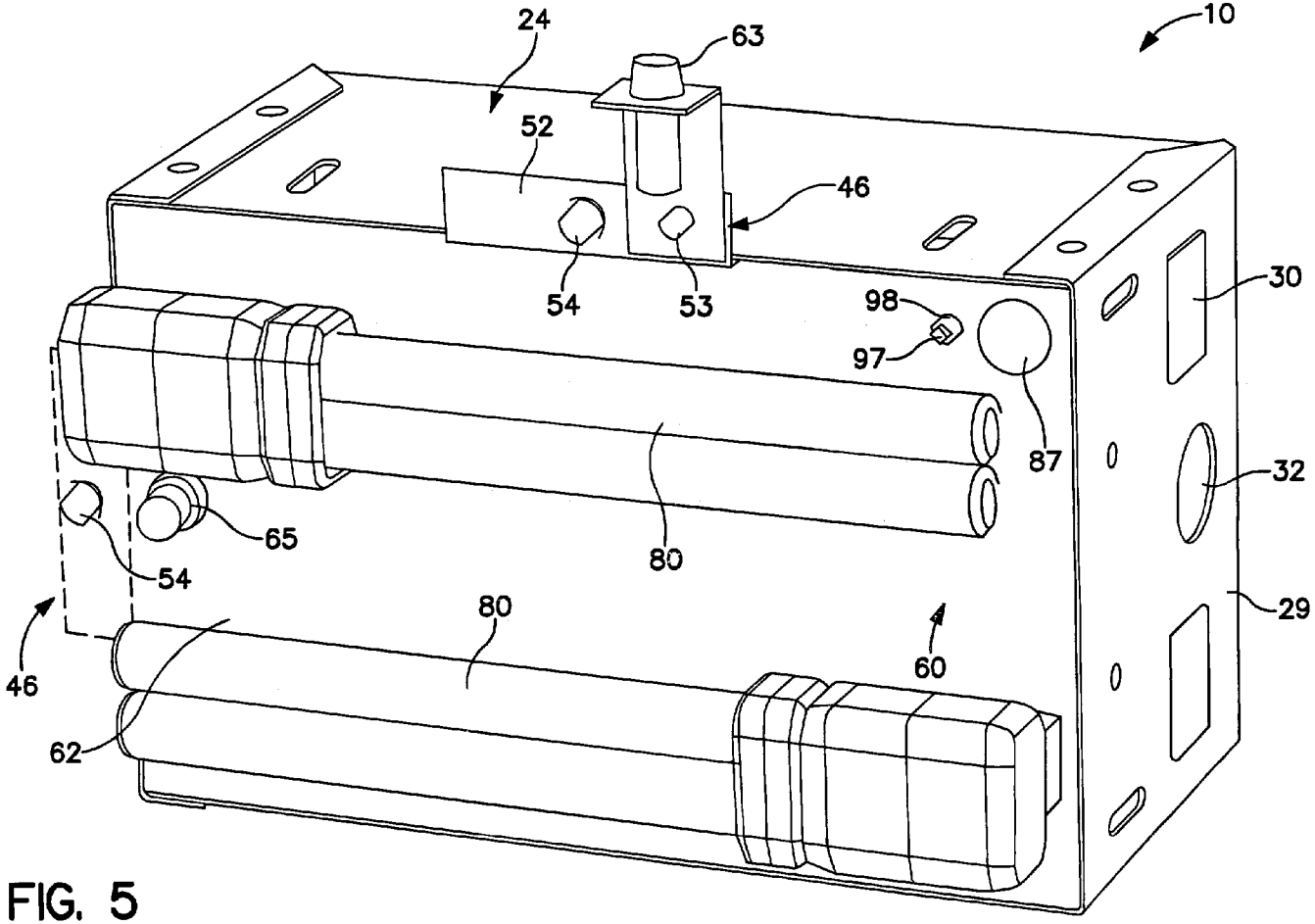
FIG. 5 is a perspective view of one embodiment of a lighting fixture of the present invention.
Figure 6:
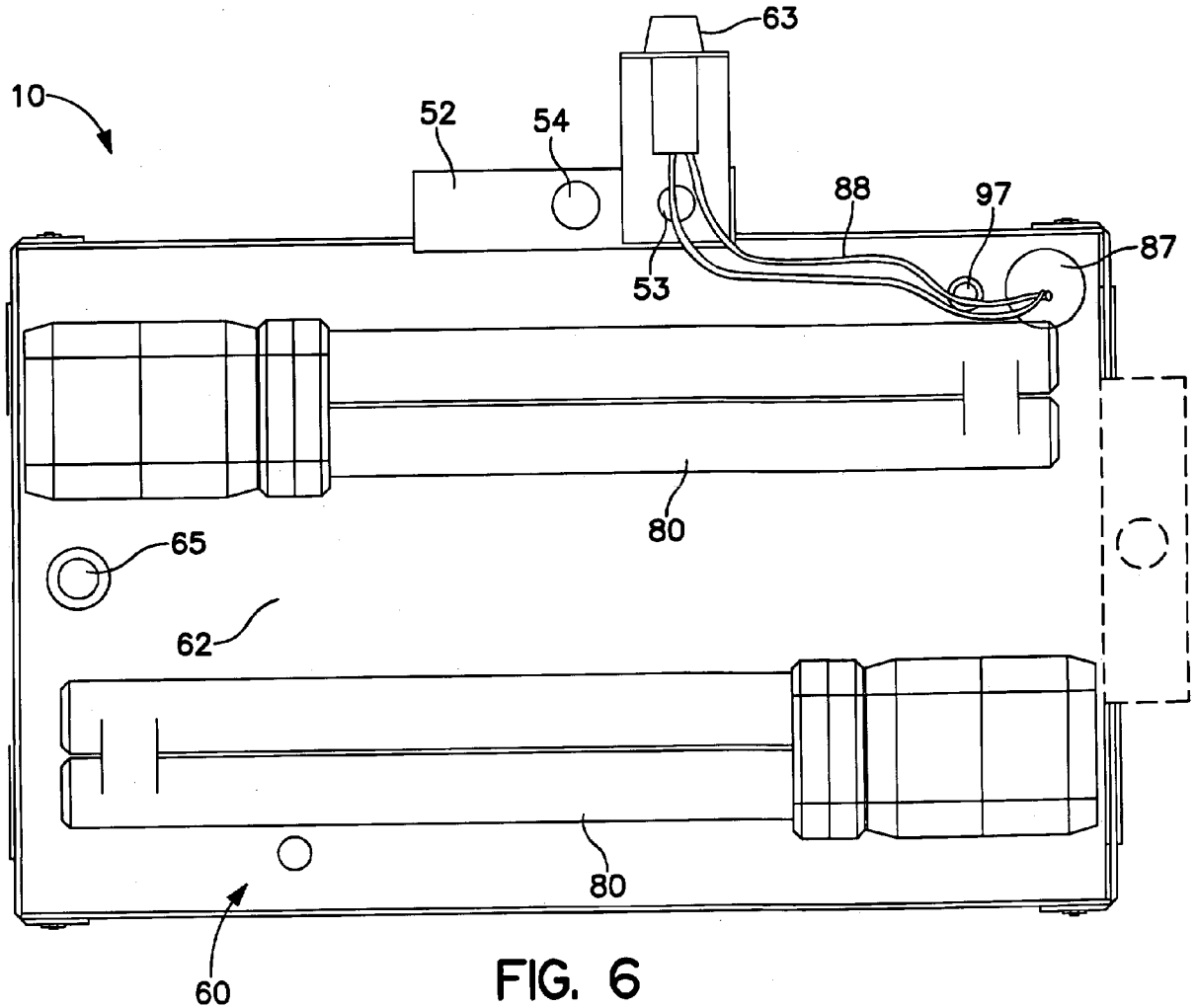
FIG. 6 is a top view of one embodiment of a lighting fixture of the present invention.

Thus, as shown in FIG. 5, the battery 64 and the lighting circuit unit 90 are completely retained within a single structure in the assembled lighting fixture 10. This integral structure can enable the recessed lighting fixture 10 to be more easily mounted in a wall and/or ceiling without occupying a large volume of space. Moreover, as stated above, the presence of the battery 64 allows the lighting fixture 10 to continue to illuminate light, even in the event of a power outage.

These and other modifications and variations of the present invention may be practiced by those of ordinary skill in the art, without departing from the spirit and scope of the present invention. In addition, it should be understood that aspects of the various embodiments may be interchanged either in whole or in part. Furthermore, those of ordinary skill in the art will appreciate that the foregoing description is by way of example only, and is not intended to limit the invention so further described in such appended claims.

What is claimed is:

1. A recessed lighting fixture, comprising:

a recessed enclosure having a back wall and an open face defined by at least two side walls;

a light source that is in operable communication with said recessed enclosure, said light source receiving power from a power supply during normal operation;

a battery assembly that is integrally connected to said recessed enclosure, said battery assembly including a battery that is capable of temporarily providing said light source with power during an outage of power from said power supply, said battery being disposed within said open face of said recessed enclosure, and said battery assembly including a ballast plate having a first surface and a second surface facing away from said first surface, said battery being connected to said first surface of said ballast plate.

2. A recessed lighting fixture as defined in claim 1, wherein said light source is connected to said second surface of said ballast plate.

3. A recessed lighting fixture as defined in claim 1, wherein at least one of said walls of said recessed enclosure defines an aperture that is capable of receiving a cable that supplies power to said light source from said power supply during normal operation.

4. A recessed lighting fixture as defined in claim 1, wherein said open face of said recessed enclosure is defined by four side walls.

5. A recessed lighting fixture as defined in claim 1, wherein said recessed enclosure has a length dimension of between about 7.5 inches to about 8 inches.

6. A recessed lighting fixture as defined in claim 1, wherein said recessed enclosure has a width dimension of between about 4.75 inches to about 5 inches.

7. A recessed lighting fixture as defined in claim 1, wherein said recessed enclosure has a depth dimension of between about 3.25 inches to about 3.5 inches.

8. A recessed lighting fixture as defined in claim 1, wherein said battery is capable of illuminating said light source for a minimum of about 90 minutes.

9. A recessed lighting fixture as defined in claim 1, wherein said light source is selected from the group consisting of a fluorescent lamp, an incandescent lamp, and combinations thereof.

10. A recessed lighting fixture as defined in claim 1, further comprising a lighting circuit unit that is in electrical communication with said light source and said battery.

11. A recessed lighting fixture as defined in claim 10, wherein said lighting circuit unit is disposed within said open face of said recessed enclosure between said battery and said back wall.

12. A recessed lighting fixture as defined in claim 1, wherein said recessed enclosure further includes a tab portion connected to at least one of said side walls.

13. A recessed lighting fixture as defined in claim 12, wherein said ballast plate is connected to said tab portion with a fastening device.

14. A recessed lighting fixture as defined in claim 1, further comprising a light diffuser that is in communication with said light source to distribute in a pattern light rays produced by said light source.

15. A recessed lighting fixture as defined in claim 14, further comprising a tray assembly connected to said recessed enclosure, said tray assembly having an upright portion that is capable of connecting to said light diffuser.

16. A recessed lighting fixture as defined in claim 1, wherein said battery has a cylindrical shape.

17. A recessed lighting fixture as defined in claim 16, wherein said cylindrical battery has a diameter of between about 0.5 inches to about 5.0 inches and a length of between about 1.0 inch to about 15.0 inches.

18. A recessed lighting fixture, comprising:

a recessed enclosure having a back wall and an open face defined by four side walls;

a light source that is in operable communication with said recessed enclosure, said light source receiving power from a power supply during normal operation;

a battery assembly that includes a ballast plate having a first surface and a second surface facing away from said first surface, said battery assembly further including a battery that is capable of temporarily providing said light source with power during an outage of power from said power supply, said first surface of said ballast plate being connected to said battery so that said battery is disposed within said open face of said recessed wall enclosure, said second surface of said ballast plate being connected to said light source; and a lighting circuit unit that is in electrical communication with said light source and said battery, said lighting circuit unit being disposed within said open face of said recessed enclosure between said battery and said back wall.

19. A recessed lighting fixture as defined in claim 18, wherein said recessed enclosure further includes a tab portion connected to at least one of said side walls.

20. A recessed lighting fixture as defined in claim 19, wherein said ballast plate is connected to said tab portion with a fastening device.

21. A recessed lighting fixture as defined in claim 18, further comprising a light diffuser that is in communication with said light source to distribute in a pattern light rays produced by said light source.

22. A recessed lighting fixture as defined in claim 21, further comprising a tray assembly connected to said recessed enclosure, said tray assembly having an upright portion that capable of connecting to said light diffuser.

23. A recessed lighting fixture, comprising:

a recessed enclosure having a back wall and an open face defined by at least two side walls, wherein said recessed enclosure has a length dimension of between about 5 inches to about 10 inches, a width dimension of between about 2 inches to about 7 inches, and a depth dimension of between about 1 inch to about 5 inches;

a light source that is in operable communication with said recessed enclosure, said light source receiving power from a power supply during normal operation; and a battery assembly that includes a ballast plate having a first surface and a second surface facing away from said first surface, said battery assembly further including a battery that is capable of temporarily providing said light source with power during an outage of power from said power supply, said first surface of said ballast plate being connected to said battery so that said battery is disposed within said open face of said recessed wall enclosure, said second surface of said ballast plate being connected to said light source.

24. A recessed lighting fixture as defined in claim 23, further comprising a lighting circuit unit that is in electrical communication with said light source and said battery, said lighting circuit unit being disposed within said open face of said recessed enclosure between said battery and said back wall.

25. A recessed lighting fixture as defined in claim 23, wherein said battery is cylindrical and has a diameter of between about 0.5 inches to about 5.0 inches and a length of between about 1.0 inch to about 15.0 inches.

26. A recessed lighting fixture as defined in claim 23, wherein said recessed enclosure further includes a tab portion connected to at least one of said side walls.

27. A recessed lighting fixture as defined in claim 26, wherein said ballast plate is connected to said tab portion with a fastening device.

28. A recessed lighting fixture as defined in claim 23, further comprising a light diffuser that is in communication with said light source to distribute in a pattern light rays produced by said light source.

29. A recessed lighting fixture as defined in claim 28, further comprising a tray assembly connected to said recessed enclosure, said tray assembly having an upright portion that capable of connecting to said light diffuser.

* * * * *